US005456355A

United States Patent [19]

Usswald et al.

[11] Patent Number: 5,456,355

[45] Date of Patent: Oct. 10, 1995

[54] GOLF BAG ACCESSORY

[75] Inventors: Craig Usswald, 5 Elizabeth Avenue, Kloof, Kwazulu Natal; Manuel F. Da Costa, Kwazulu Natal, both of South Africa

[73] Assignee: Usswald; Craig, South Africa

[21] Appl. No.: 333,789

[22] Filed: Nov. 3, 1994

[30] Foreign Application Priority Data

Nov. 5, 1993 [ZA] South Africa ..... 93/8276

[51] Int. Cl.[6] ..... A63B 55/04

[52] U.S. Cl. ..... 206/315.7; 248/96

[58] Field of Search ..... 206/315.7, 315.2; 248/96, 188.7, 346, 685

[56] References Cited

U.S. PATENT DOCUMENTS

| | | | |
|---|---|---|---|
| 1,606,113 | 11/1926 | Walcott | 248/96 |
| 1,606,133 | 11/1926 | Smythe . | |
| 1,621,329 | 3/1927 | Malone | 206/315.7 X |
| 1,657,170 | 1/1928 | McLaren | 248/96 |
| 1,715,101 | 5/1929 | Shanahan . | |
| 1,955,463 | 4/1934 | Lathrop | 206/315.7 |
| 2,275,297 | 3/1942 | Hearnshaaw | 248/96 |
| 3,747,882 | 7/1973 | Leis | 206/315.7 X |
| 4,782,948 | 11/1988 | Weise | 206/315.7 |
| 5,222,703 | 6/1993 | Ricciardelli | 248/96 |

FOREIGN PATENT DOCUMENTS 201454 10/1922 United Kingdom .

*Primary Examiner*—Allan N. Shoap
*Assistant Examiner*—Christopher J. McDonald
*Attorney, Agent, or Firm*—Willian Brinks Hofer Gilson & Lione

[57] ABSTRACT

A golf bag accessory is provided for supporting a golf bag in an upright configuration. The accessory is mounted beneath the base member of a golf bag and includes blade-like elements that are displaceable between an inoperative position in which they are disposed substantially entirely within the outer perimeter of the base member of the bag and an operative position in which they extend radially beyond the outer perimeter of the base member of the bag. In this operative position the blade-like elements effectively enlarge the diameter of the base member and thereby render the bag self-supporting in its upright configuration.

14 Claims, 2 Drawing Sheets

GOLF BAG ACCESSORY

A golf bag generally comprises an elongate slender holding formation extending from a substantially rigid base member at one end thereof. When supported in a substantially upright configuration on the base member, the holding formation can receive the shafts of a plurality of golf clubs therein, the heads of the golf clubs ordinarily remaining outside the holding formation. A strap is conventionally attached to the holding formation in a configuration in which it can serve to carry the complete golf bag over the shoulder of a person. The general configuration of a golf bag of the above type and the mode of carrying the golf bag are well known and, as such, are not described in any further detail herein. Also, any reference hereinafter to a golf bag must be interpreted as a reference to a golf bag of the above general type.

Because of the slender configuration of the holding formation and the resulting relatively small size of the base member, only larger sized golf bags can support themselves in an upright configuration via their base member on a support surface, and even such larger bags are not very stable when so supported. Golf bags therefore are usually placed on their sides while golf clubs are not removed from or inserted into the bags and this clearly is very inconvenient. When they are left in an upright configuration supported via their base member, eg larger bags, they often fall over and this can cause damage to both the golf bags and the clubs held therein.

In order to alleviate the above problem, golf bag stands having legs which together with a golf bag form a tripod configuration are provided, the stands being attached to the golf bags in a suitable configuration to permit the bags to become self-supportable in an angled upright configuration. Although effective for the purpose, the stands render the golf bags more difficult to carry and also render the bags less compact for storage purposes, it often being required that the stands have to be removed from their bags in order to permit storage of the bags, particularly in the trunks of motor vehicles. The disadvantages apply even though the legs of the stands are collapsible when the bags are lifted from the ground.

As an alternative to the above golf bag stands, golf bags have been provided with blade-like arms displaceably secured beneath the ordinary base members of the bags, the blade-like arms being displaceable between an inoperative position in which they are disposed within the ordinary bag perimeter beneath the bags and an operative position in which they extend radially from the bags to effectively increase the size of the base of the bags and thereby render the bags self-supporting in an upright configuration.

For example, U.S. Pat. No. 2,275,297 discloses a bag having four such blade-like arms that are manually and individually displaceable between their inoperative and operative positions, the required manual displacement of the blade-like arms clearly being inconvenient and, therefore, impractical. British Patent 201,454 and U.S. Pat. No. 4,782,948 each discloses a golf bag having such blade-like arms that can be displaced together by the rotation of an elongate stem extending through the centre of the golf bag to a location near its operative top end where a handle formation is provided, the stem being operatively linked via an operating mechanism to the blade-like arms. Disadvantages associated with these golf bags include that the elongate stem and golf clubs held in the bag often interfere with one another, and because of the general construction the rotation of the elongate stem is difficult to effect, particularly when the displacement of the blade-like arms are interfered with. Also, the relevant mechanisms form an integral part of the bags and interfere with the normal use of the bags when carried on golf carts or where the mechanisms are otherwise not required.

U.S. Pat. No. 1,606,133 discloses an alternative structure of the above type where a displaceable operating member beneath the bag is displaced by supporting the bag thereon, the displacement resulting in the displacement of blade-like arms into a suitable operative position. This golf bag suffers from the same disadvantages as described above, a further particular disadvantage being that its blade-like arms will be displaced into their operative position whenever the bag is supported on its operating member, even when this is not required. Also, the path of displacement of the blade-like arms from their inoperative position to their operative position is such that they can cause injury to a person positioned too near a bag when placed on the ground.

U.S. Pat. No. 1,715,101 provides the only disclosure of an accessory-type device that is secured to a golf bag for the above purpose, the operation of the device being essentially the equivalent of the mechanism associated with the golf bag disclosed in U.S. Pat. No. 1,606,133. The device is not conveniently separable from its golf bag and essentially suffers from the same disadvantages described above.

Accordingly, it is an object of this invention to provide an accessory for a golf bag that can fulfil the function of radially extending the effective base of a golf bag to enable its free independent support in an upright configuration.

It is a further object of this invention to provide an accessory that incorporates an operating mechanism for displacing its blade-like arms in a simple, yet effective manner between their inoperative and operative positions and to provide an accessory that is easily removable from a golf bag when not required for use and that does not unduly affect the compactness of the golf bag when secured thereto.

According to the invention there is provided a golf bag accessory, which comprises a pair of disk-like members secured to one another in a parallel adjacent configuration in which they are rotatable with respect to one another about a central axis perpendicular to their general plane;

at least three blade-like arms displaceably located between the disk-like members, being operatively linked with the disk-like members in a configuration in which, by rotation of the disk-like members with respect to one another between two limit positions, the blade-like arms are displaceable between an inoperative position in which they are disposed substantially entirely within the outer perimeter of the disk-like members and an operative position in which they extend radially beyond the outer perimeter of the disk-like members; and mounting means for securely mounting one of the pair of disk-like members on a golf bag in a configuration in which the said one disk-like member is disposed operatively beneath the base of the golf bag and the other disk-like member defines an external support face for supporting the golf bag in an upright configuration on a support surface.

The pair of disk-like members may define complementary formations rotatably locating them with respect to one another in their required configuration. Also, the pair of disk-like members may be secured together by a bolt and nut, or any other suitable means.

The golf bag accessory of the invention preferably includes five blade-like arms, although it may also include even more blade-like arms.

Furthermore, the pair of disk-like members may define an internal space for each blade-like arm, within which the blade-like arm is receivable in its inoperative position.

According to one particular configuration of the invention, each blade-like arm is pivotally located on a pivot formation defined by one disk-like member and mechanically engaged with the other disk-like member by complementary engagement formations in a configuration in which, by rotation of one disk-like member with respect to the other disk-like member, the engagement formations provide for the displacement of the blade-like arms between their inoperative and operative positions. The complementary engagement formations may comprise gear formations defined in each blade-like arm and the disk-like member mechanically engaged therewith and, particularly, each blade-like arm defines a projecting sleeve formation whereby it is pivotally located on its pivot formation, the sleeve formation defining external gear teeth formations that are mechanically engaged with teeth of a gear formation defined by the disk-like member mechanically engaged therewith.

The mounting means of the golf bag accessory of the invention may include at least two mounting brackets located on the said one of the pair of disk-like members whereby the said one disk-like member can be mounted on a golf bag. Each mounting bracket may be adjustably located on the said one of the pair of disk-like members for accommodating mounting of the accessory on golf bags defining different base sizes. Each mounting bracket may define holes for receiving screws whereby the mounting bracket can be secured to a golf bag. Alternative means for this purpose clearly also may be provided for the purpose, eg clamping means, or the like.

The said external face of the said other disk-like member of the pair of disk-like members particularly defines gripping formations for gripping a support surface on which a golf bag having the accessory mounted thereon can be supported in its upright configuration. The gripping formations may be defined by rib formations formed to grip soil and grassed support surfaces. Alternatively, or in addition, the gripping formations include rubber stud formations formed to grip rigid support surfaces.

The invention extends also to a golf bag which has an accessory, in accordance with the invention, mounted thereon.

Further features of the golf bag accessory of the invention, including the mode of use and the operation thereof, are described in more detail hereinafter with reference to an example of the invention illustrated by way of the accompanying diagrammatic drawings. In the drawings.

Figure 1:
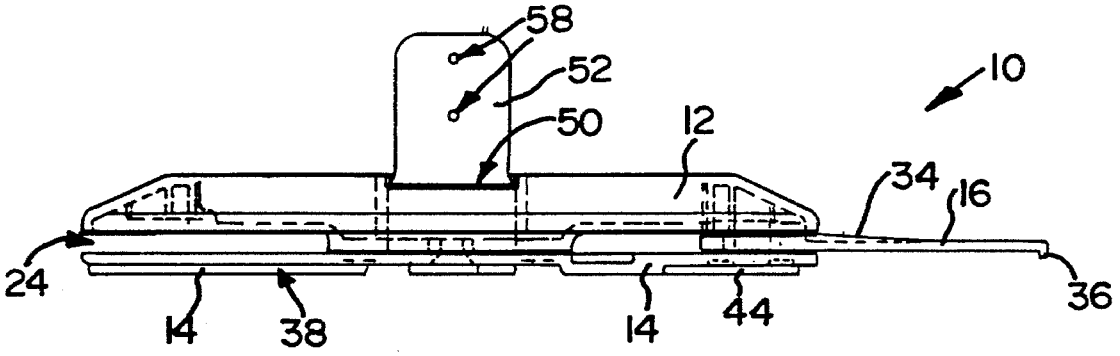
FIG. 1 shows a side view of a golf bag accessory, in accordance with the invention.

Referring initially to FIGS. 1 to 4 of the drawings, a golf bag accessory, in accordance with the invention, is designated generally by the reference numeral 10. The golf bag accessory 10 includes generally a pair of disk-like members including an upper disk-like member 12 and a lower disk-like member 14, the disk-like members having five blade-like arms 16 displaceably located between them, the arms 16 being displaceable between an inoperative position in which they are disposed substantially entirely within the outer perimeter of the disk-like members (as shown in dotted lines in FIG. 4 of the drawings) and an operative position in which they extend radially beyond the outer perimeter of the disk-like members (as shown in solid lines in FIG. 4 of the drawings).

The lower disk-like member 14 defines a centrally located apertured stud formation 18 on which the upper disk-like member 12 is located via an aperture therein, thereby providing for rotation of the disk-like members with respect to one another about a central axis 20 disposed substantially perpendicularly to the general plane of the disk-like members 12 and 14. The two disk-like members, 12 and 14, are secured together in this configuration by a bolt and nut 22, thereby securing their location with respect to one another.

The two disk-like members, 12 and 14, further define five internal spaces 24 between them, each space 24 providing for the location of a blade-like arm 16 when displaced into its inoperative position in which it is located between the disk-like members, 12 and 14, to be disposed substantially entirely within the outer perimeter defined by the disk-like members.

Figure 3:
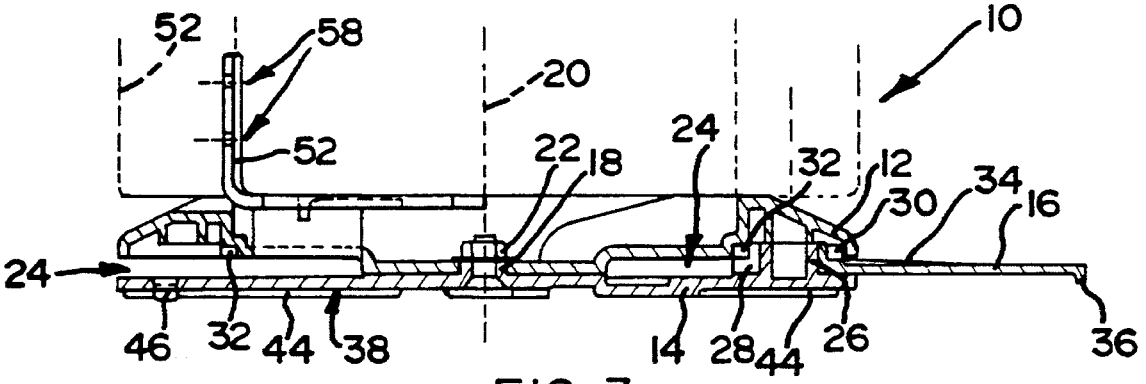
FIG. 3 shows a cross-sectional side view of the golf bag accessory of FIG. 1.
Figure 4:
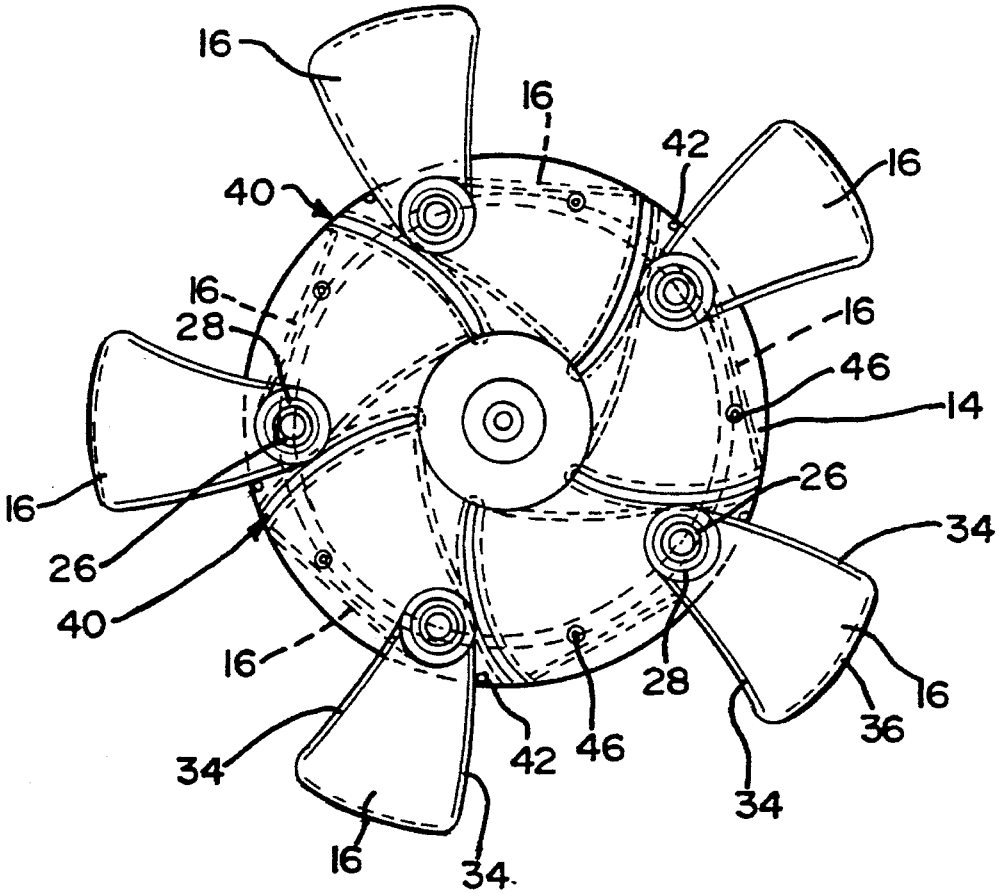
FIG. 4 shows a top plan view of the lower disk-like member of the golf bag accessory of FIG. 1.

As is illustrated clearly in FIG. 3 of the drawings, the lower disk-like member 14 defines a pivot formation 26 for each blade-like arm 16, each blade-like arm 16 defining a sleeve formation 28 extending from the general plane of the blade-like member and which is rotatably located on a pivot formation 26, which permits the required displacement of each blade-like arm between its inoperative and operative positions. Each sleeve formation 26 defines external gear teeth formations 30 that are mechanically engaged with the teeth 32 of a gear formation defined by the upper disk-like member 12, so that rotation of the upper disk-like member 12 with respect to the lower disk-like member 14 between two predetermined limit positions will provide for the simultaneous displacement of the blade-like arms 16 between their inoperative and operative positions (only shown clearly in FIG. 3 of the drawings).

Each blade-like arm 16 defines two upwardly projecting rib formations 34 extending along the opposite radially extending sides thereof and a downwardly projecting lip formation 36 at its end remote from the disk-like member 14 when disposed in its operative position, the rib formations 34 providing structural strength to the blade-like arm 16 whereas the lip formation 36 depends to a level approaching the operative external face 38 of the lower disk-like member 14. As is clearly illustrated in FIG. 4 of the drawings, the lower disk-like member 14 defines a channel formation 40 for receiving the lip formation of each blade-like arm 16, thereby providing for the effective location of the blade-like arms between the disk-like members in their inoperative position, while simultaneously minimising the space between the disk-like members to thereby enhance the compactness of the accessory 10. The lower disk-like member 14 further defines a projecting stud formation 42 for each blade-like element 16, each stud formation 42 being disposed to act as a stop for determining the operative position of each blade-like arm 16.

Still further, the operatively downwardly facing external face 38 of the lower disk-like member 14 defines a plurality of rib formations 44 which can act to grip a soil or grassed support surface when supported on such a support surface for the purpose described hereafter, a plurality of rubber stud formations 46 being provided for gripping more rigid support surfaces.

Figure 2:
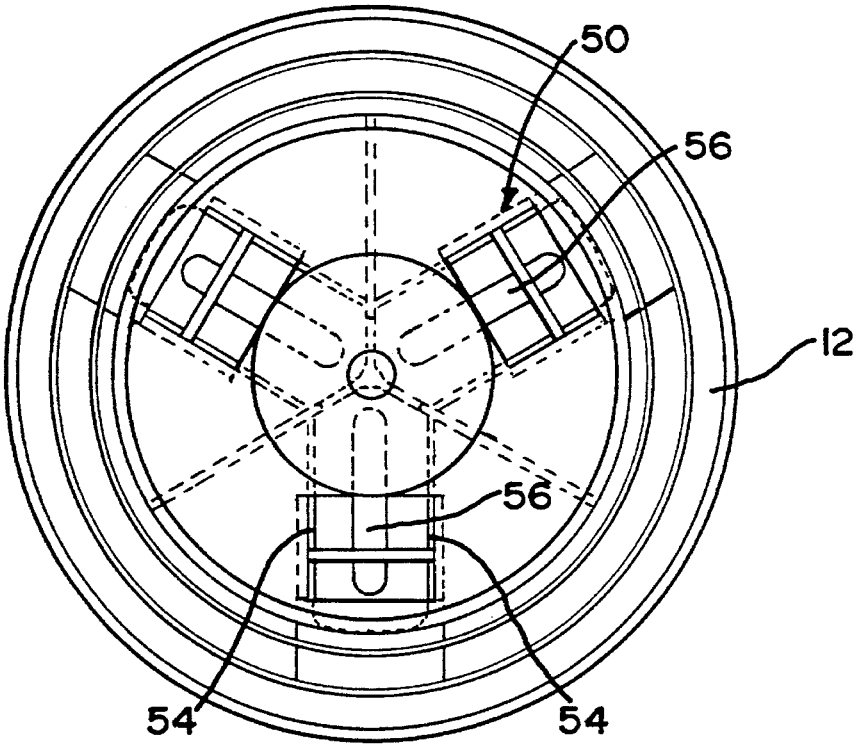
FIG. 2 shows a bottom plan view of the upper disk-like member of the golf bag accessory of FIG. 1.

The upper disk-like member 12 defines three radially extending locating channel formations 50 within which right angled mounting brackets 52 are slideably located as shown, opposing teeth formations in the regions 54 as shown in FIG. 2 optionally being provided for engagement between the upper disk-like member 12 and the mounting brackets 52, for securing the radial location of the mounting brackets with respect to the upper disk-like member 12. As such, the position of the mounting brackets 52 can be adjusted from the position as shown in solid lines in FIG. 3 to the position as shown in dotted lines, the mounting brackets 52 being located particularly for mounting the accessory 10 onto the base of a golf bag. As is shown in FIG. 2 of the drawings, the base part of each mounting bracket 52 defines an elongate slot 56 which permits effective compression of the base parts of the brackets 52 and resulting disengagement of the engaging teeth formations, thereby permitting the adjustment of the position of the brackets 52 with respect to the disk-like member 12, as illustrated in FIG. 3 of the drawings. The location between each mounting bracket 52 and the upper disk-like member 12 also may be provided for by friction between them.

By providing for this adjustability of the mounting brackets 52, the accessory 10 can be mounted on a range of different sized golf bags with the base member of the golf bags being positioned between the brackets, it being envisaged particularly that for mounting the accessory 10 onto a golf bag, the mounting brackets will be positioned in a position in which the base member of a golf bag can be snugly received between them, thus permitting the brackets to be secured to this base member by means of screws, or the like, passing through apertures 58 in the brackets 52.

Figure 5:
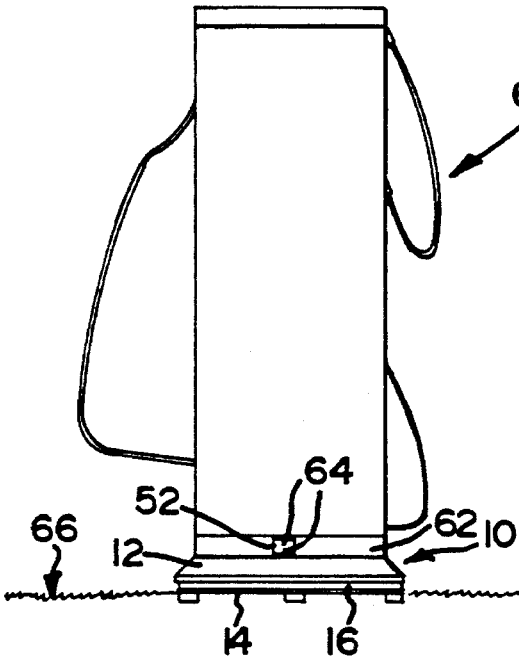
FIG. 5 illustrates in side view the configuration of a golf bag having the golf bag accessory of FIG. 1 mounted thereon, the golf bag accessory being illustrated in its inoperative configuration.
Figure 6:
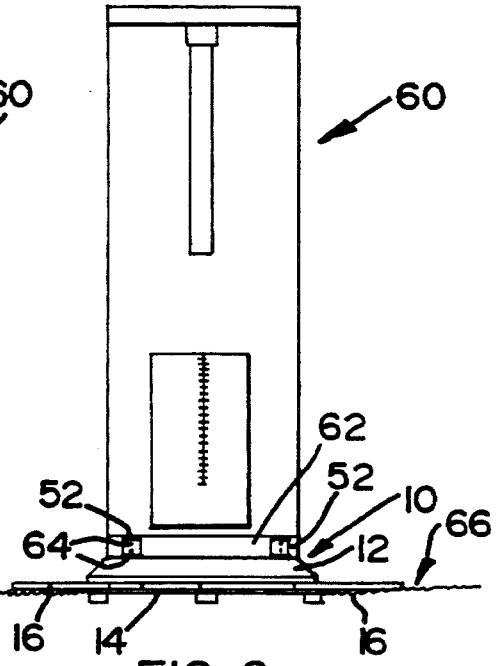
FIG. 6 shows a front view of the golf bag of the FIG. 5, illustrating the golf bag accessory in its operative configuration.

Referring now also to FIGS. 5 and 6 of the drawings, there is shown a golf bag 60 which has an accessory 10 mounted thereon via mounting brackets 52 that are secured to the base part 62 of the golf bag 60 by means of suitable screws 64. FIG. 5 illustrates the accessory in its inoperative position while being supported on a grassed support surface 66, the stud formations 46 effectively pushing into the surface while the rib formations 44 effectively engage the surface, thereby permitting rotation of the upper disk-like member 12 with respect to the lower disk-like member 14, thus permitting the displacement of the blade-like arms 16 from their inoperative position as shown in FIG. 5, into their operative position as shown in FIG. 6. Rotation of the upper disk-like member 12 with respect to the lower disk-like member 14 will be effected by simply rotating the golf bag, when supported on the support surface 66, by acting on the operative upper end of the golf bag, thereby rendering use of the accessory simple, yet effective. Clearly, rotation of the golf bag in one direction will provide for displacement of the blade-like arms from their inoperative position to their operative position, whereas reverse rotation will provide for the return of the blade-like arms to their inoperative position. When supported on a rigid support surface, the rubber stud formations 46 provide the necessary grip between the lower disk-like member 14 and the support surface, for permitting rotation of the upper disk-like member 12 with respect thereto.

As is apparent from the drawings, the accessory of the invention is a very compact unit that will not unduly add to the size of the golf bag and, as such, it will remain possible to store the golf bag in any conventional locations including also within the trunk of a motor vehicle. It is envisaged particularly that all the components and parts of the accessory of the invention will be manufactured of a synthetic plastic material and, as such, the accessory will be very light and will not unduly add to the mass of the golf bag for carrying purposes.

By displacing the blade-like element 16 of the accessory from their inoperative position to their operative position, the base size of the golf bag is effectively enlarged (see FIG. 4), thus enhancing the stability of the golf bag when supported in an upright configuration on a support surface. Through this enlarged base size it will be possible to support a golf bag in this upright configuration even on slanted and uneven ground, thus rendering the removal of golf clubs from the golf bag and the insertion of the golf clubs back into the golf bag a convenient operation and simultaneously providing for protection against damage to the golf bag and the golf clubs held therein.

We claim:

1. A golf bag accessory, which comprises a pair of disc-like members secured to one another in a parallel adjacent configuration in which they are rotatable with respect to one another about a central axis perpendicular to their general plane;

at least three blade-like arms displaceably located between the disk-like members, being operatively linked with the disk-like members in a configuration in which, by rotation of the disk-like members with respect to one another between two limit positions, the blade-like arms are displaceable between an inoperative position in which they are disposed substantially entirely within the outer perimeter of the disk-like members and an operative position in which they extend radially beyond the outer perimeter of the disk-like members; and mounting means for securely mounting one of the pair of disk-like members on a golf bag in a configuration in which the said one disk-like member is disposed operatively beneath the base of the golf bag and the other disk-like member defines an external support face for supporting the golf bag in an upright configuration on a support surface.

2. A golf bag accessory as claimed in claim 1, in which the pair of disk-like members define complementary formations rotatably locating them with respect to one another in their required configuration.

3. A golf bag accessory as claimed in claim 2, in which the pair of disk-like members are secured together by a bolt and nut.

4. A golf bag accessory as claimed in claim 1, which includes five blade-like arms.

5. A golf bag accessory as claimed in claim 1, in which the pair of disk-like members defines an internal space for each blade-like arm, within which the blade-like arm is receivable in its inoperative position.

6. A golf bag accessory as claimed in claim 1, in which each blade-like arm is pivotally located on a pivot formation defined by one disk-like member and mechanically engaged with the other disk-like member by complementary engagement formations in a configuration in which, by the rotation of one disk-like member with respect to the other disk-like member, the engagement formations provide for the displacement of the blade-like arms between their inoperative and operative positions.

7. A golf bag accessory as claimed in claim 6, in which the complementary engagement formations comprise gear formations defined on each blade-like arm and the disk-like member mechanically engaged therewith.

8. A golf bag accessory as claimed in claim 7, in which each blade-like arm defines a projecting sleeve formation whereby it is pivotally located on its pivot formation, the sleeve formation defining external gear teeth formations that are mechanically engaged with teeth of a gear formation defined by the disk-like member mechanically engaged therewith.

9. A golf bag accessory as claimed in claim 1, in which the mounting means includes at least two mounting brackets located on the said one of the pair of disk-like members whereby the said one disk-like member can be mounted on a golf bag.

10. A golf bag accessory as claimed in claim 9, in which each mounting bracket is adjustably located on the said one of the pair of disk-like members for accommodating mounting of the accessory on golf bags defining different base sizes.

11. A golf bag accessory as claimed in claim 9, in which each mounting bracket defines holes for receiving screws whereby the mounting bracket can be secured to a golf bag.

12. A golf bag accessory as claimed in claim 1, in which the said external support face of the said other disk-like member of the pair of disk-like members defines gripping formations for gripping a support surface on which a golf bag having the accessory mounted thereon can be supported in its upright configuration.

13. A golf bag accessory as claimed in claim 12, in which the gripping formations are defined by rib formations formed to grip soil and grassed support surfaces.

14. A golf bag accessory as claimed in claim 12, in which the gripping formations include rubber stud formations formed to grip rigid support surfaces.

* * * * *